US006878912B2

(12) United States Patent
Lee et al.

(10) Patent No.: US 6,878,912 B2
(45) **Date of Patent: *Apr. 12, 2005**

(54) METHOD OF CONTROLLING MICROWAVE OVEN

(75) Inventors: Sung-Ho Lee, Suwon (KR); Chul Kim, Seongnam (KR); Young-Won Cho, Suwon (KR); Tae-Soo Kim, Seoul (KR)

(73) Assignee: Samsung Electronics, Co., LTD, Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 10/189,588

(22) Filed: Jul. 8, 2002

(65) Prior Publication Data

US 2003/0146209 A1 Aug. 7, 2003

(30) Foreign Application Priority Data

Feb. 6, 2002 (KR) ..... 2002-6696

(51) Int. Cl.[7] ..... H05B 6/68

(52) U.S. Cl. ..... 219/707; 219/705; 219/719; 99/325

(58) Field of Search ..... 219/707, 719, 219/702, 704, 705, 492, 757; 99/325, 451

(56) References Cited

U.S. PATENT DOCUMENTS 4,692,597 A * 9/1987 Tsuda et al. ..... 219/719
4,791,263 A * 12/1988 Groeschel, Jr. ..... 219/707
4,864,088 A * 9/1989 Hiejima et al. ..... 219/707
6,279,464 B1 8/2001 Lo et al.

FOREIGN PATENT DOCUMENTS

GB 2 255 205 * 10/1992 ..... 219/707
JP 53-137446 * 11/1978 ..... 219/707
JP 3-110323 * 5/1991 ..... 219/707

OTHER PUBLICATIONS

U.S. Appl. No. 10/189,559, filed Jul. 8, 2002, Sung–Ho Lee et al., Samsung Electronics Co., Ltd.
U.S. Appl. No. 10/189,590, filed Jul. 8, 2002, Sung–Ho Lee et al., Samsung Electronics Co., Ltd.

* cited by examiner

*Primary Examiner*—Philip H. Leung
(74) *Attorney, Agent, or Firm*—Staas & Halsey LLP

(57) ABSTRACT

A method of controlling a microwave oven, in which the microwave oven includes a cooking chamber for containing food therein, a cooling fan which circulates air, a magnetron which generates microwaves and a humidity sensor which senses humidity of the cooking chamber. Cooking instruction(s) may be preset or set manually by a user. A first cooking operation is performed while preventing water from boiling off/to overflow by controlling an output power of the magnetron according to the set cooking instruction(s). A time required to perform a later cooking is set according to a time required to perform the first cooking operation. A second cooking operation is performed for the later cook time while controlling the output power of the magnetron to reduce the overall cook time of the food.

25 Claims, 7 Drawing Sheets

METHOD OF CONTROLLING MICROWAVE OVEN

CROSS-REFERENCE TO RELATED APPLICATIONS

This application claims the benefit of Korean Patent Application No. 2002-6696 filed on Feb. 6, 2002, in the Korean Industrial Property Office, the disclosure of which is incorporated herein by reference.

BACKGROUND OF THE INVENTION

1. Field of the Invention

The present invention relates to a method of controlling a microwave oven which can cook rice in a bowl.

2. Description of the Related Art

Generally, a microwave oven is a machine which cooks foods by the frictional heat of water molecules in the foods. The microwave oven radiates microwaves of 2450 MHz to a cooking chamber using a magnetron to repeatedly change a molecular arrangement of water contained in the foods. In order to satisfy various requirements of customers, some of the microwave ovens are equipped with a humidity sensor which allows the microwave ovens to automatically cook food by sensing a water vapor generated from the food.

A conventional microwave oven may also have cooking menus to cook rice. However, a rice cooking menu the conventional microwave oven is a cooking program based on a general instruction to cook rice for more than two to four people. That is, the conventional microwave oven cannot control the output power of the magnetron to cook rice for one person. Therefore, if a user cooks rice for one person using the conventional microwave oven, water contained with the rice in a container overflows and boils over the container prior to steam boiling the rice. The result is an ineffective cooking operation and rice that is insufficiently cooked or steamed.

SUMMARY OF THE INVENTION

Accordingly, it is an object of the present invention is to provide a method of controlling a microwave oven, which can quickly cook rice for one person and steam boil the rice in a bowl while preventing water from boiling to overflow.

Additional objects and advantages of the invention will be set forth in part in the description which follows and, in part, will be obvious from the description, or may be learned by practice of the invention.

To achieve the above and other objects of the present invention, there is provided a method of controlling a microwave oven having a cooking chamber for containing food therein, a cooling which circulates air, a magnetron which generates microwaves and a humidity sensor which senses humidity of the cooking chamber, the method comprising setting a cooking instruction, performing a first cooking while preventing water from boiling to overflow by controlling an output power of the magnetron according to the cooking instruction; setting a later cook time according to a time required to perform the first cooking, and performing a second cooking for the later cook time while controlling the output power of the magnetron to rapidly cook and reduce the later cook time.

BRIEF DESCRIPTION OF THE DRAWINGS

These and other objects and advantages of the present invention will become apparent and more readily appreciated from the following description of the embodiments, taken in conjunction with the accompanying drawings of which.

DETAILED DESCRIPTION OF THE PREFERRED EMBODIMENTS

Figure 1:
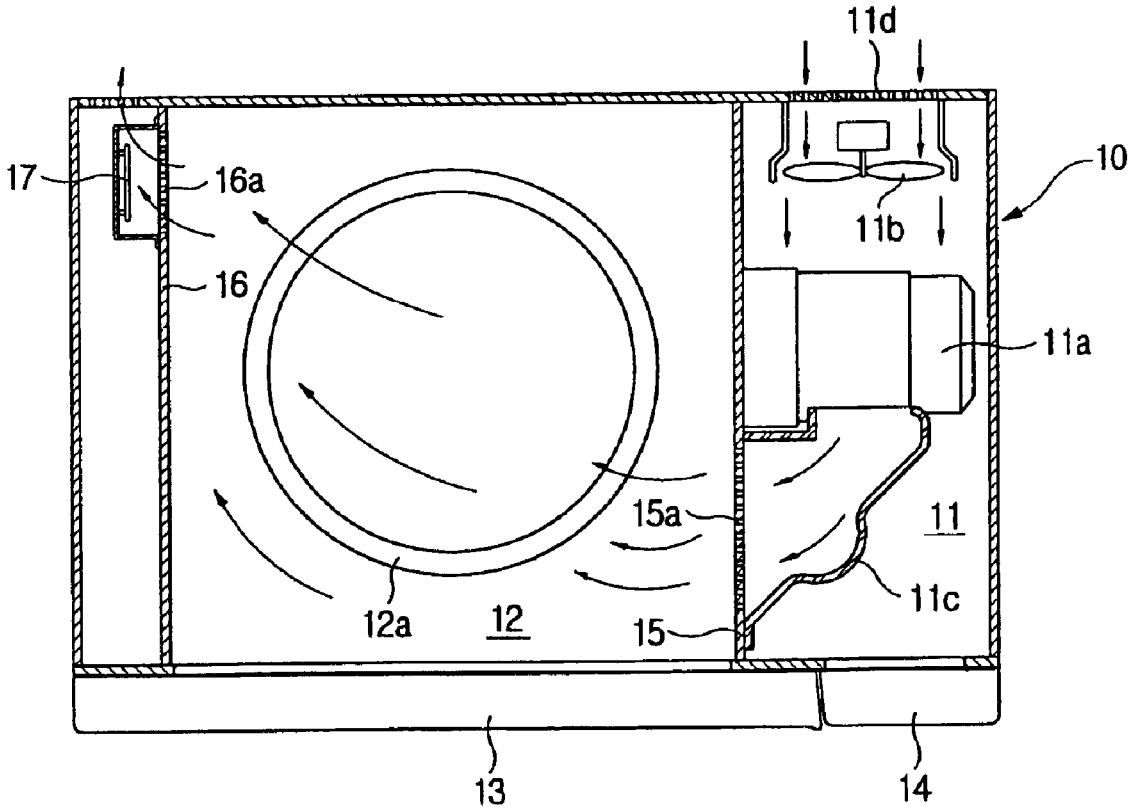
FIG. 1 is a cross sectional view of a microwave oven according to an embodiment of the present invention.

Reference will now be made in detail to the embodiments of the present invention, examples of which are illustrated in the accompanying drawings, wherein like reference numerals refer to the like elements throughout. The embodiments are described below in order to explain the present invention by referring to the figures.

FIG. 1 shows a microwave oven according to an embodiment of the present invention. The microwave oven comprises a body 10 which constitutes an external shape of the microwave oven and defines a cooking chamber 12 and a machine room 11 partitioned from the cooking chamber 12, a door 13 connected to the body 10 by a hinge (not shown) to selectively open and shut the cooking chamber 12, a control panel 14 installed on the front of the body 10 and provided with a plurality of functional buttons thereon (not shown), and a humidity sensor 17 which senses humidity of the cooking chamber 12.

The cooking chamber 12 is formed to be open at its front, wherein a cooking tray 12*a* in a form of a turntable is installed on a bottom of the cooking chamber 12 and a motor (not shown) is installed under the cooking tray 12*a* to rotate the cooking tray 12*a*. An inlet 15*a* which communicates with the machine room 11 to suck external air into the cooking chamber 12 is formed on a front portion of one sidewall 15 of the cooking chamber 12. An outlet 16*a* is formed on a back portion of the other sidewall 16 of the cooking chamber 12 to discharge air in the cooking chamber 12 to the outside.

The machine room 11 includes a magnetron 11*a* which oscillates microwaves, a cooling fan 11 which to sucks external air to cool the machine room 11, and a guide duct 11*c* which guides air in the machine room 11 to the inlet 15*a*. The cooling fan 11*b* is disposed between the magnetron 11*a* and a back wall of the machine room 11. A plurality of suction holes 11*d* are formed in the back wall of the machine room 11 to suck the external air into the machine room 11.

The humidity sensor 17 is mounted on the other sidewall 16 of the cooking chamber 12 adjacent to the outlet 16*a* to be disposed in an air discharging path of the cooking chamber 12. Therefore, the humidity sensor 17 senses the humidity of the air being discharged from the cooking chamber 12 through the outlet 16*a*. The humidity sensor 17 is electrically connected to a control unit formed in the control panel 14, as will be described later.

Figure 2:
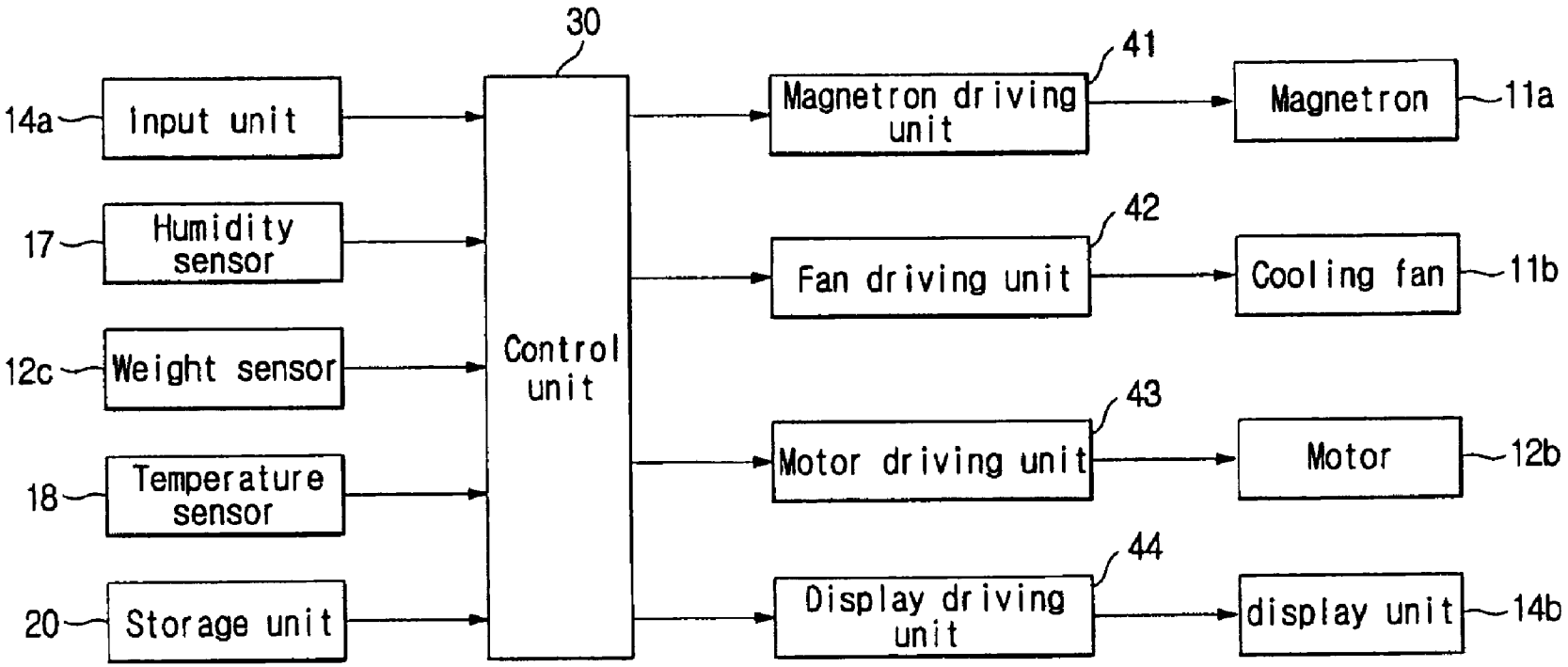
FIG. 2 is a block diagram of the microwave oven shown in FIG. 1.

FIG. 2 is a block diagram of the microwave oven shown in FIG. 1.

Referring to FIG. 2, the microwave oven further comprises a control unit 30 which controls the entire operations of the microwave oven. The control unit 30 is connected to an input unit 14*a* arranged in the control panel 14 and receives operation commands from a user. In addition, the control unit 30 is connected to the humidity sensor 17 which senses humidity, a weight sensor 12*c* installed under the cooking tray 12*a* which senses the weight of the food, and a temperature sensor 18 which detects a temperature of the food or the cooking chamber 12. A storage unit 20 is electrically connected to the control unit 30 and stores data. Furthermore, the control unit 30 is electrically connected to a magnetron driving unit 41 which drives the magnetron 11*a*, a fan driving unit 42 which drives the cooling fan 11*b*, a motor driving unit 43 which drives a motor 12*b* for rotating the cooking tray 12*a*, and a display driving unit 44 which drives a display unit 14*b* arranged in the control panel 14 to display information.

The storage unit 20 stores various factors preset according to the kind and the amount of food, and various data generated during a cooking operation.

The microwave oven of the present invention having the above construction cooks food by radiating the microwaves oscillated by the magnetron 11*a* to the cooking chamber 12 where the user puts the food on the cooking tray 12*a* and manipulates the input unit 14*a* of the control panel 14 to operate the microwave oven.

An external air is sucked into the machine room 11 through the suction holes 11*d* to cool the machine room 11 using the cooling fan 11*b* during a cooking operation of the microwave oven. The external air is provided to the cooking chamber 12 through the guide duct 11*c* and the inlet 15*a*. Then, the air in the cooking chamber 12 is discharged to the outside through the outlet 16*a*, together with a water vapor generated from the food, as shown by arrows in FIG. 1. Accordingly, smell and the water vapor can be eliminated from the cooking chamber 12. In this case, air in the cooking chamber 12 is discharged to the outside while being brought into contact with the humidity sensor 17. Accordingly, the humidity sensor 17 senses the water vapor contained in the discharged air and transmits sensing signals to the control unit 30.

The control unit 30 drives the magnetron 11*a*, the motor 12*b* and the cooling fan 11*b* to automatically cook the food based on the electrical signals (including output signals from the weight sensor 12*c* and the temperature sensor 18) received from the humidity sensor 17.

Hereinafter, a method of controlling an output power of the magnetron 11*a* of the microwave oven to cook rice in a bowl according to the present invention will be described.

Figure 3A:
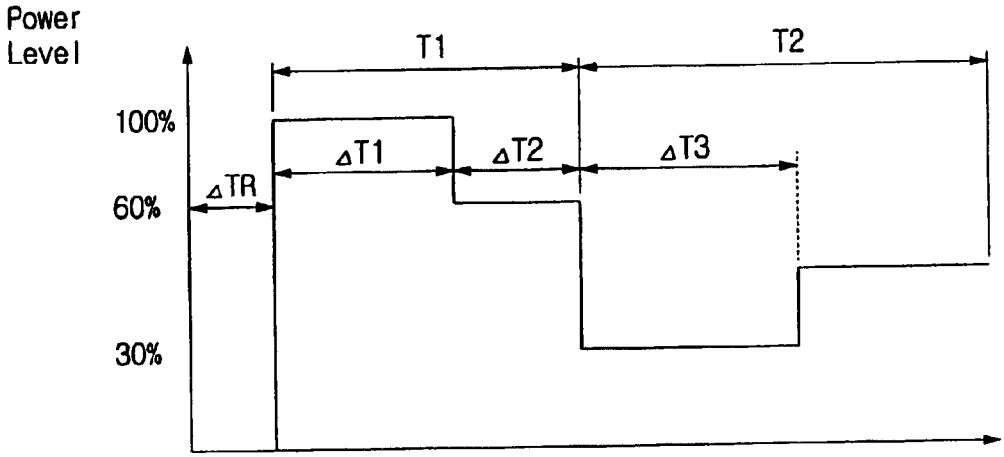
FIGS. 3A and 3B are graphs showing the output power control of the microwave oven of FIGS. 1 and 2 according to the present invention.
Figure 3B:
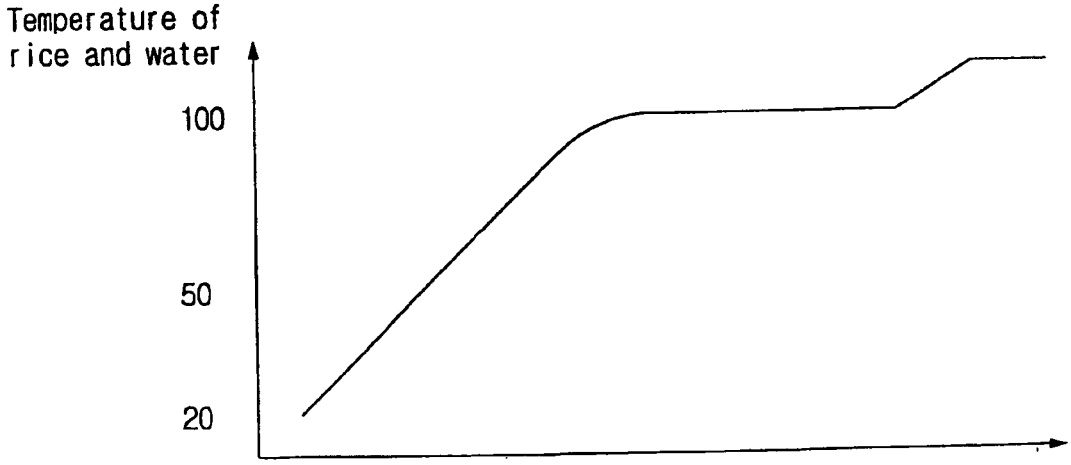

FIGS. 3A and 3B show graphs illustrating an output power level as a function of time to describe the method controlling the output power of the magnetron 11*a* of the microwave oven to cook food.

At the start of a cooking operation, the microwave oven cooks food by maximizing the output power of the magnetron for a predetermined period of time. After the predetermined period of time elapses, the microwave oven cooks the food after decreasing the output power of the magnetron, until the water boils. At this time, a first cooking time T1 is set as an elapsed time prior to boiling of the water. A second cooking time T2 is calculated based on the first cooking time T1 and a preset factor.

The second cooking time T2 is a period of time for steam boiling the food. The magnetron 11*a* operates at a low power required to steam boil the food for a steam boil time ΔT3 of the second cooking time T2. After the steam boil time ΔT3 elapses, the output power of the magnetron is increased to rapidly cook the food. After the second cooking time T2 elapses, the cooking is finished.

FIGS. 4 to 7 show flowcharts of the method of controlling the microwave oven to cook food according to the present invention. With reference to FIGS. 1–3A, the method of controlling the microwave oven will be described below.

A user puts food on the cooking tray 12*a* of the cooking chamber 12. Then, the user manipulates the functional buttons of the input unit 14*a* on the control panel 14 to set a cooking instruction, after the door 13 is shut, in operation 100.

Then, the control unit 30 determines whether a current set instruction is for cooking rice in a bowl, according to information input through the input unit 14*a* in operation 200. Where the current set instruction is for cooking the rice in a bowl in the operation 200, the control unit 30 determines whether a cooking start instruction has been input through the input unit 14*a* in operation 300.

Where the cooking start instruction has been input in the operation 300, the control unit 30 performs an initializing operation in operation 400. In order to perform the initializing operation, the control unit 30 controls the fan driving unit 42 to operate the cooling fan 11*b* for an initialization time ΔTR. In this case, the control unit 30 does not operate the magnetron 11*a*.

After the initializing operation for the initialization time ΔTR, the control unit 30 performs a first cooking operation in operation 500. After the first cooking operation, the control unit 30 sets the second cooking time T2 based on the time T1 required to perform the first cooking operation and a factor which is preset according to the kind of food and stored in the storage unit 20. Then, the control unit 30 performs the second cooking operation for the second cooking time T2 in operation 600. After the second cooking operation is completed, the control unit 30 controls the magnetron driving unit 41 to stop the operation of the magnetron 11*a*, and controls the fan driving unit 42 to stop the operation of the cooling fan 11*b*, thus completing the cooking operation in operation 700.

Figure 4:
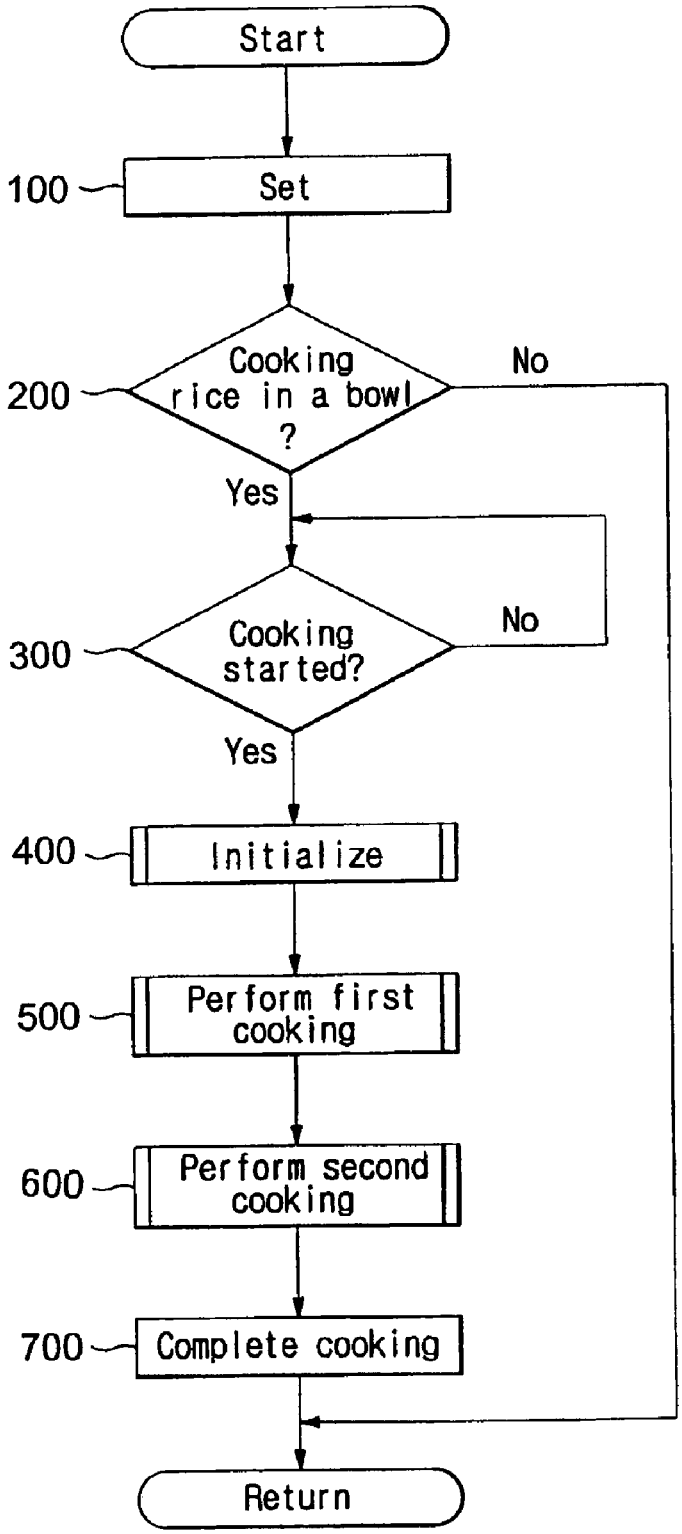
FIG. 4 is a flowchart of a method of controlling the microwave oven shown in FIGS. 1 and 2 according another to the embodiment of present invention.
Figure 5:
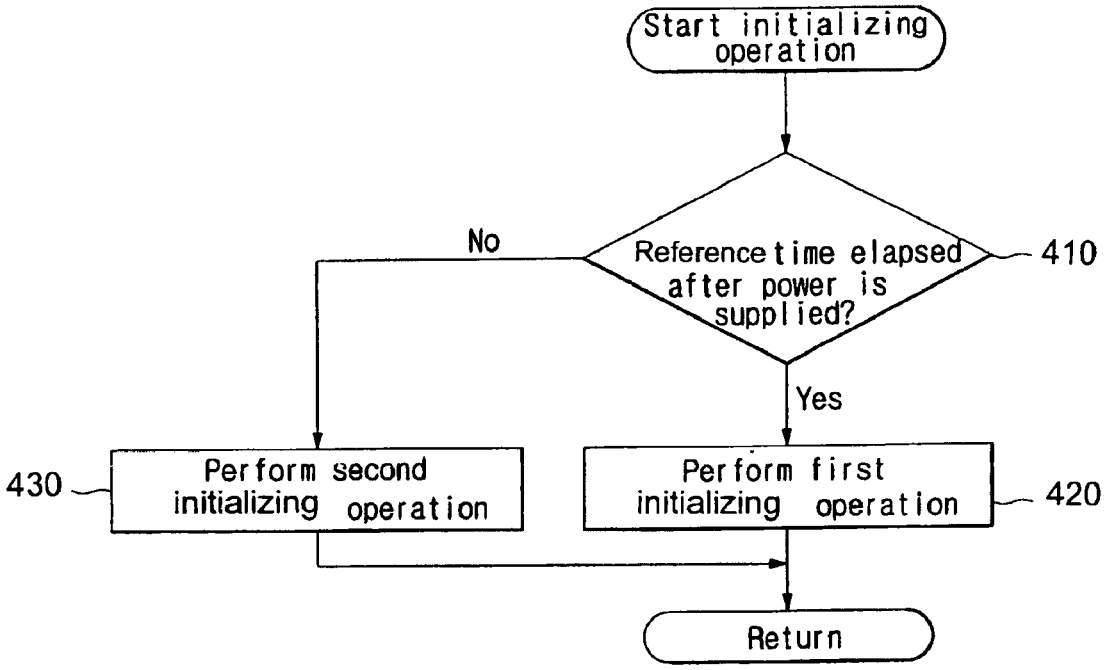
FIG. 5 is a detailed flowchart illustrating an initializing operation of the method of FIG. 4.

The initializing operation 400 of FIG. 4 is shown in FIG. 5 and is described in detail with reference to FIGS. 1–3A.

The control unit 30 determines whether a reference time has elapsed after power is supplied in operation 410. Where the reference time has elapsed, the control unit 30 executes a first initializing operation to drive only the cooling fan 11*b* for a preset first initializing time in operation 420. However, if the reference time did not elapse in the operation 410, the control unit 30 executes a second initializing operation to perform an initializing operation for a time which is longer than the preset first initializing time in operation 430.

Figure 6:
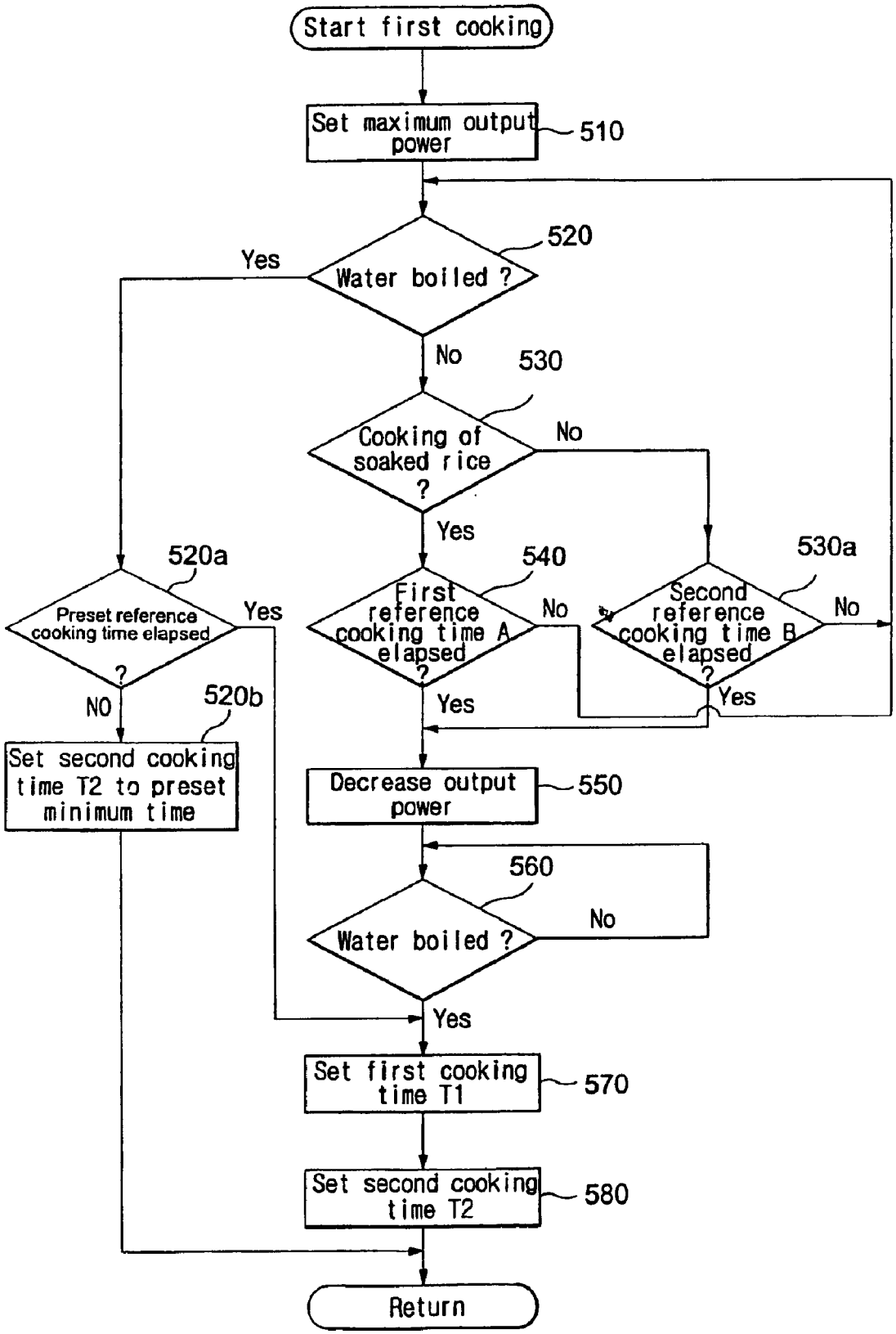
FIG. 6 is a detailed flowchart illustrating a first cooking operation of the method of FIG. 4.

The first cooking operation 500 of FIG. 4 is shown in FIG. 6 and is described in detail with reference to FIGS. 1–3A.

In order to perform the first cooking operation, the control unit 30 sets the output power of the magnetron 11*a* to a maximum output power in operation 510. Then, the control unit 30 controls the magnetron driving unit 41 to operate the magnetron 11*a* at the maximum output power.

The magnetron 11*a* radiates the microwaves to the cooking chamber 12, and the food irradiated by the microwaves is cooked by a frictional heat due to a rapid molecular motion of the water. As the cooling fan 11*b* is driven, the external air is sucked into the machine room 11 through the suction holes 11*d*, and is provided to the cooking chamber 12 through the guide duct 11*c* and the inlet 15*a*, while cooling the magnetron 11*a* and a high voltage transformer (not shown). Then, the air provided to the cooking chamber 12 is discharged to the outside through the outlet 16*a* together with vapor generated during the cooking operation.

Referring back to FIG. 6, the control unit 30 determines whether the water has boiled through the humidity sensor 17 in operation 520. Where the water does not boil at that point, the control unit 30 determines whether an instruction set at the setting operation 100 of FIG. 4 is for cooking of a soaked rice in operation 530. Where the set instruction is for cooking of the soaked rice, the control unit 30 determines whether a preset first reference time A has elapsed in operation 540. Where the preset first reference time A has elapsed in the operation 540, the control unit 30 controls the magnetron driving unit 41 to decrease the output power of the magnetron 11*a* so as to prevent the water from overflowing in operation 550.

On the other hand, where the set instruction is not for cooking of the soaked rice in the operation. 530, the control unit 30 determines whether a preset second reference time B has elapsed in operation 530*a*. Where the preset second reference time B has elapsed in the operation 530*a*, the control unit 30 controls the magnetron driving unit 41 to decrease the output power of the magnetron 11*a* so as to prevent the water from overflowing in the operation 550.

The preset first and second reference times A and B correspond to the ΔT1 shown in FIG. 3A. ΔT1 is a time required to operate the magnetron 11*a* at the maximum output power to heat food until it boils.

After the operation 550, the control unit 30 determines whether the water has boiled through the humidity sensor 17 in operation 560. Where the water has boiled in the operation 560, the control unit 30 sets an elapsed time before the water boils as the first cooking time T1 in operation 570. The control unit 30 sets the second cooking time T2 based on the set first cooking time T1 in operation 580. That is, the control unit 30 sets the second cooking time T2 by adding the first cooking time T1 to a determined period of time, or by multiplying the first cooking time T1 by the preset factor according to the kind of food being cooked.

On the other hand, where the water boils through the humidity sensor 17 in the operation 520, the control unit 30 determines whether an elapsed time before the water boils exceeds a preset reference cooking time in operation 520*a*. Where the elapsed time does not exceed the present reference cooking time in the operation 520*a*, the control unit 30 sets the second cooking time T2 to a preset minimum time in operation 520*b*, and returns to an initial operation of the second cooking operation 600 of FIG. 4. Where the elapsed time exceeds the preset reference cooking time in the operation 520*a*, the control unit 30 controls to proceed to the operation 570.

Figure 7:
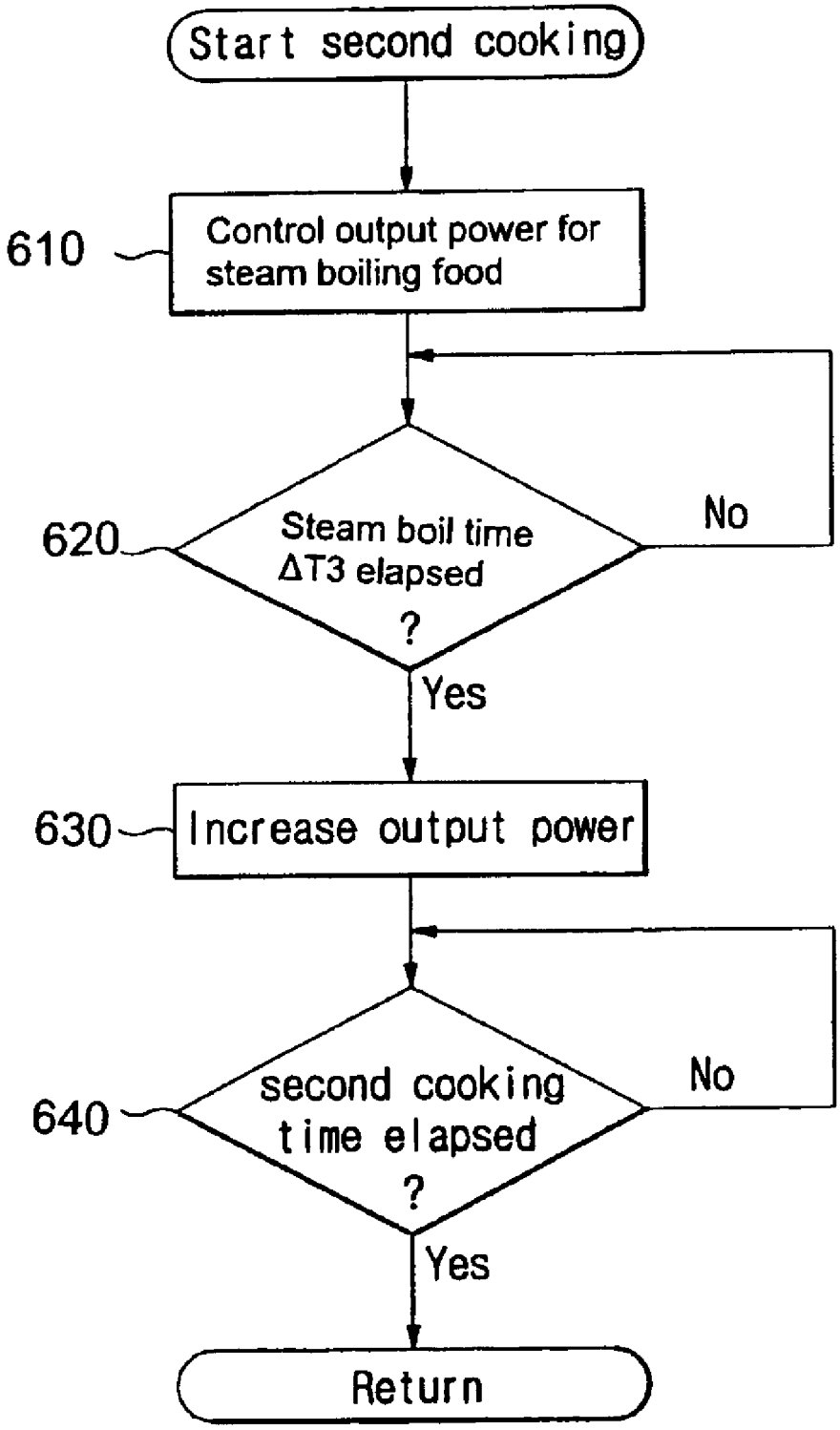
FIG. 7 is a detailed flowchart illustrating a second cooking operation of the method of FIG. 4.

The second cooking operation 600 of FIG. 4 is shown in FIG. 7, and is described in detail with reference to FIGS. 1–3A.

The second cooking operation 600 is an operation to steam boil the food. The control unit 30 controls the magnetron driving unit 41 to set a current output power of the magnetron 11*a* to an output power preset for steam boiling the food in operation 610.

The control unit 30 determines whether the steam boil time (ΔT3 of FIG. 3) preset for steam boiling the food has elapsed in operation 620. Where the steam boil time (ΔT3) has elapsed in the operation 620, the control unit 30 controls the magnetron driving unit 41 to increase the output power of the magnetron 11*a* so as to perform a rapid cooking in operation 630, and reduce the entire cooking time of the food.

The control unit 30 determines whether the second cooking time T2 has elapsed, while cooking the food, after increasing the output power of the magnetron 11*a* in operation 640. A length of time, which has elapsed after the output power of the magnetron 11*a* is increased, is obtained by subtracting the steam boil time ΔT3 from the second cooking time T2.

Where the second cooking time T2 has elapsed in the operation 640, the control unit 30 returns to an initial operation of the complete cooking operation 700 of FIG. 4.

As described above, the present invention provides a method of controlling a microwave oven, which can prevent water from boiling off/to overflow by decreasing the output power of the microwave oven before the water boils while cooking rice in a bowl. The present method also performs a rapid cooking by increasing the output power of the microwave oven in response to elapse of the steam boil time. Accordingly, the overall cook time and the power consumption of the microwave oven are reduced.

The present method allows rice, whether an amount for one person or for several people, to be evenly cooked throughout. That is, with the application of the present method, a single serving of rice in a container, submerged in water, can be steam boiled evenly as the cooking time and the output of the magnetron is controlled so as not to allow the water to boil to overflow off the container. It is understood that the present invention can be applied to cook a single or multiple servings of soup, coffee, and other food items with or without the container.

A system which uses the present invention also includes permanent or removable storage, such as magnetic and optical discs, RAM, ROM, etc., on which the process and data structures of the present invention can be stored and distributed. The operations can also be distributed via, for example, downloading over a network such as the Internet.

Although a few embodiments of the present invention have been shown and described, it will be appreciated by those skilled in the art that changes may be made in these embodiments without departing from the principles and spirit of the invention, the scope of which is defined in the appended claims and their equivalents.

What is claimed is:

1. A method of controlling a microwave oven having a cooking chamber for containing food therein, a cooling fan which circulates air, and a magnetron which generates microwaves, the method comprising:

setting a cooking instruction;

performing a first cooking for a first cook time while preventing water from boiling to overflow by controlling an output power of the magnetron according to the cooking instruction;

setting a second cook time according to the first cook time required to perform the first cooking; and immediately after performing the first cooking, performing a second cooking for the second cook time while controlling the output power of the magnetron to rapidly finish cooking the food such that the output power of the magnetron is set at plural different output power levels during the second cook time.

2. The method of claim 1, further comprising performing an initializing operation to operate only the cooling fan for an initialization time prior to the first cooking.

3. A method of controlling a microwave oven having a cooking chamber for containing food therein, a cooling fan which circulates air, and a magnetron which generates microwaves, the method comprising:

setting a cooking instruction;

performing a first cooking for a first cook time while preventing water from boiling to overflow by controlling an output power of the magnetron according to the cooking instruction;

setting a second cook time according to the first cook time required to perform the first cooking;

performing a second cooking for the second cook time while controlling the output power of the magnetron to rapidly finish cooking the food; and performing an initializing operation to operate only the cooling fan for an initialization time prior to the first cooking, wherein the performing of the initializing operation comprises:

determining a power supply time, performing a first initializing operation to operate only the cooling fan for a first initializing time in response to the power supply time being shorter than or equal to a reference time, and performing a second initializing operation to operate only the cooling fan for a second initializing time in response to the power supply time being longer than the reference time, wherein the second initializing time is shorter than the first initializing time.

4. A method of controlling a microwave oven having a cooking chamber for containing food therein, a cooling fan which circulates air, a magnetron which generates microwaves and a humidity sensor which senses humidity of the cooking chamber, the method comprising:

setting a cooking instruction;

performing a first cooking for a first cook time while preventing water from boiling to overflow by controlling an output power of the magnetron according to the cooking instruction;

setting a second cook time according to the first cook time required to perform the first cooking; and performing a second cooking for the second cook time while controlling the output power of the magnetron to rapidly finish cooking the food, wherein the performing of the first cooking comprises:

operating the magnetron at a maximum output power, determining whether an operating time of the magnetron at the maximum output power exceeds a predetermined period of time, controlling the output power of the magnetron to be lower than the maximum output power so as to prevent the water from boiling to overflow in response to the operating time exceeding the predetermined period of time, sensing boiling of the water through the humidity sensor, and determining the second cook time based on an elapsed time prior to the boiling of the water in response to the sensing of the boiling of the water by the humidity sensor.

5. The method of claim 4, wherein the controlling of the output power to be lower in the first cooking comprises:

controlling the output power of the magnetron to be lower than the maximum output power in response to the operating time of the magnetron exceeding a first reference time and the setting of the cooking instruction being an instruction to cook rice soaked in the water, and controlling the output power of the magnetron to be lower than the maximum output power in response to the operating time of the magnetron exceeding a second reference time, which is longer than the first reference time, and the setting of the cooking instruction being not for cooking of the rice soaked in the water.

6. The method of claim 4, wherein the second cook time is a result of multiplying the first cook time required to perform the first cooking by a preset factor according to a kind of the food being cooked.

7. The method of claim 4, wherein the second cook time is a result of adding the first cook time required to perform the first cooking to a determined period of time.

8. The method of claim 4, wherein the determining of the second cook time comprises:

determining whether a preset reference time elapsed in response to the boiling of the water sensed through the humidity sensor after the operating of the magnetron at the maximum output power at the first cooking, and setting the second cook time as a preset minimum time in response to the preset reference time not being elapsed.

9. The method of claim 1, wherein the performing of the second cooking comprises:

setting the output power of the magnetron to a preset output power for steam boiling of the food to cook the food;

determining whether a steam boil time elapsed;

controlling the output power of the magnetron to be equal to or greater than the preset output power for steam boiling the food in response to an elapse of the steam boil time;

determining whether the second cook time elapsed; and stopping operations of the magnetron and the cooling fan in response to the elapse of the second cook time.

10. The method of claim 8, wherein the setting of the second cook time is determined by one of the results of multiplying the first cook time required to perform the first cooking by a preset factor, and adding the first cook time required to perform the first cooking to a determined period of time, in response to an elapse of the preset reference time.

11. A computer readable medium encoded with operating instructions for implementing a method of controlling a microwave oven having a cooling fan and a magnetron to cook food, performed by a computer, the method comprising:

setting a cooking instruction;

performing a first cooking for a first cook time while preventing water from boiling to overflow by controlling an output power of the magnetron according to the cooking instruction;

setting a second cook time according to the first cook time required to perform the first cooking; and immediately after performing the first cooking, performing a second cooking for the second cook time while controlling the output power of the magnetron to rapidly finish cooking the food such that the output power of the magnetron is set at plural different output power levels during the second cook time.

12. The computer readable medium of claim 11, further comprising performing an initializing operation to operate only the cooling fan for an initialization time prior to the first cooking.

13. A computer readable medium encoded with operating instructions for implementing a method of controlling a microwave oven having a cooling fan and a magnetron to cook food, performed by a computer, the method comprising:

setting a cooking instruction;

performing a first cooking for a first cook time while preventing water from boiling to overflow by controlling an output power of the magnetron according to the cooking instruction;

setting a second cook time according to the first cook time required to perform the first cooking;

performing a second cooking for the second cook time while controlling the output power of the magnetron to rapidly finish cooking the food; and performing an initializing operation to operate only the cooling fan for an initialization time prior to the first cooking, wherein the performing of the initializing operation comprises:

determining a power supply time, performing a first initializing operation to operate only the cooling fan for a first initializing time in response to the power supply time being shorter than or equal to a reference time, and performing a second initializing operation to operate only the cooling fan for a second initializing time in response to the power supply time being longer than the reference time, wherein the second initializing time is shorter than the first initializing time.

14. A computer readable medium encoded with operating instructions for implementing a method of controlling a microwave oven having a cooling fan and a magnetron to cook food, performed by a computer, the method comprising:

setting a cooking instruction;

performing a first cooking for a first cook time while preventing water from boiling to overflow by controlling an output power of the magnetron according to the cooking instruction;

setting a second cook time according to the first cook time required to perform the first cooking; and performing a second cooking for the second cook time while controlling the output power of the magnetron to rapidly finish cooking the food, wherein the performing of the first cooking comprises:

operating the magnetron at a maximum output power, determining whether an operating time of the magnetron at the maximum output power exceeds a predetermined period of time, controlling the output power of the magnetron to be lower than the maximum output power so as to prevent the water from boiling to overflow in response to the operating time exceeding the predetermined period of time, sensing boiling of the water through the humidity sensor, and determining the second cook time based on an elapsed time prior to the boiling of the water in response to the sensing of the boiling of the water by a humidity sensor which senses humidity of the cooking chamber.

15. The computer readable medium of claim 14, wherein the controlling of the output power to be lower in the first cooking comprises:

controlling the output power of the magnetron to be lower than the maximum output power in response to the operating time of the magnetron exceeding a first reference time and the setting of the cooking instruction being an instruction to cook rice soaked in the water, and controlling the output power of the magnetron to be lower than the maximum output power in response to the operating time of the magnetron exceeding a second reference time, which is longer than the first reference time, and the setting of the cooking instruction being not for cooking of the rice soaked in the water.

16. The computer readable medium of claim of 14, wherein the second cook time is a result of multiplying the first cook time required to perform the first cooking by a preset factor according to a kind of food being cooked.

17. The computer readable medium of claim of 14, wherein the second cook time is a result of adding the first cook time required to perform the first cooking to a determined period of time.

18. The computer readable medium of claim of claim 14, wherein the determining of the second cook time comprises:

determining whether a preset reference time elapsed in response to the boiling of the water sensed through the humidity sensor after the operating of the magnetron at the maximum output power at the first cooking, and setting the second cook time as a preset minimum time in response to the preset reference time not being elapsed.

19. The computer readable medium of claim of claim 11, wherein the performing of the second cooking comprises:

setting the output power of the magnetron to a preset output power for steam boiling of the food to cook the food;

determining whether a steam boil time elapsed;

controlling the output power of the magnetron to be equal to or greater than the preset output power for steam boiling the food in response to an elapse of the steam boil time;

determining whether the second cook time elapsed; and stopping operations of the magnetron and the cooling fan in response to an elapse of the second cook time.

20. The computer readable medium of claim 18, wherein the setting of the second cook time is determined by one of the results of multiplying the first cook time required to perform the first cooking by a preset factor, and adding the first cook time required to perform the first cooking to a determined period of time, in response to an elapse of the preset reference time.

21. A microwave oven comprising:

a cooking chamber for containing food therein;

a magnetron which generates microwaves to cook the food;

a humidity sensor which senses humidity in the cooking chamber; and a controller which controls a cooking operation of the microwave oven, wherein the controller controls the microwave oven to perform a first cooking operation for a first cook time while preventing water from boiling to overflow by controlling an output power of the magnetron, and to perform a second cooking operation immediately after the first cooking operation for a second cook time based on the first cook time and the humidity sensor, while controlling the output power of the magnetron to rapidly finish cooking the food such that the output power of the magnetron is set at plural different output power levels during the second cook time.

22. A method of controlling a microwave oven having a cooking chamber for containing food therein, a cooling fan which circulates air, a magnetron which generates microwaves and a humidity sensor which senses humidity of the cooking chamber, the method comprising:

setting a cooking instruction;

performing a first cooking for a first cook time comprises:

operating the magnetron at a maximum output power for a predetermined period of time according to the cooking instruction, and lowering an output power of the magnetron to a first output power so as to prevent water from boiling to overflow in response to an elapse of the predetermined time;

determining the first cook time in response to sensing boiling of the water through the humidity sensor; and performing a second cooking for a second cook time comprises:

lowering the output power of the magnetron to a second output power to steam boil the food, operating the magnetron at the second output power for a portion of the second cook time, and operating the magnetron for a remainder of the second cook time after raising the output power of the magnetron to a third output power to rapidly finish cooking the food in response to an elapse of the portion of the second cook time, wherein the second cook time is based the first cook time.

23. The method of claim 22, wherein the determining of the first cook time comprises setting the first cook time as an elapsed time prior to the boiling of the water sensed by the humidity sensor.

24. The method of claim 23, wherein the second output power is lower than the first output power.

25. The method of claim 24, wherein the third output power is higher than the second output power, and lower than the first output power.

* * * * *